US006979387B2

(12) United States Patent
Takeuchi et al.

(10) Patent No.: US 6,979,387 B2
(45) **Date of Patent: *Dec. 27, 2005**

(54) DOCTOR BLADE FOR REMOVING WATER

(75) Inventors: Tetsuo Takeuchi, Tokyo (JP); Hirofumi Ishii, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 319 days.

This patent is subject to a terminal disclaimer.

(21) Appl. No.: 10/383,205

(22) Filed: Mar. 6, 2003

(65) Prior Publication Data

US 2003/0168196 A1 Sep. 11, 2003

(30) Foreign Application Priority Data

Mar. 8, 2002 (JP) ..... 2002-063928

(51) Int. Cl.[7] ..... B31F 1/12

(52) U.S. Cl. ..... 162/281; 162/263; 162/199; 15/298.1; 15/256.51; 15/256.5; 15/298.7; 428/114; 399/350; 118/123; 118/413

(58) Field of Search ..... 162/263, 281, 162/199; 15/298.1, 256.51, 256.5, 298.7; 428/114; 399/350; 118/123, 413

(56) References Cited

U.S. PATENT DOCUMENTS 6,643,890 B2 * 11/2003 Carrier ..... 15/256.51

FOREIGN PATENT DOCUMENTS

JP 56-20697 2/1981

* cited by examiner

*Primary Examiner*—Mark Halpern
(74) *Attorney, Agent, or Firm*—Howson and Howson

(57) ABSTRACT

In laminated, resin-impregnated doctor blades for removing water from a grooved belt in the press part of a papermaking machine, fibers of the belt-contacting layer are oriented in the direction of travel of the belt. The doctor blade so constructed exhibits greater adhesion to the belt, an improved water-removal capability, and greater durability, when compared with a doctor blade having randomly oriented surface fibers.

4 Claims, 6 Drawing Sheets

FIG. 5(a)

| Structural part | Item | Comparative example-1 | Comparative example-2 | Example-1 | Example-2 | Example-3 | Example-4 | Example-5 |
|---|---|---|---|---|---|---|---|---|
| Felt part | Base material | PET basis weight 100g/m$^2$ | ← | ← | ← | ← | ← | ← |
| | Batt material | 17dtex (All layers) | ← | ← | ← | 17dtex (All layers) | 40dtex (Seven layers on top side) 17dtex (Other layers) | 40dtex and 17dtex (1:1) (Seven layers on top side) 17dtex (Other layers) |
| | Batt basis weight | 120g/m$^2$ | ← | ← | ← | ← | ← | ← |
| | Fiber layer wherein fiber is oriented in the direction of travel of elastic belt | None | ← | All layers | All layers | Seven layers on top side which is in contact with elastic belt | Seven layers on top side which is in contact with elastic belt | Seven layers on top side which is in contact with elastic belt |
| | Density | 0.35 | ← | ← | ← | ← | ← | ← |
| Resin part | Material | SBR | ← | ← | ← | ← | ← | ← |
| | Density | 1.0 | ← | ← | ← | ← | ← | ← |
| | Resin impregnation rate(R/F)% | 2 0 | ← | ← | ← | ← | ← | ← |
| | T(mm) | 10 | 5 | 10 | 5 | 10 | 10 | 10 |
| Durability | Compared by ratio | 100 | 92 | 110 | 101 | 115 | 124 | 120 |
| Water removing capability | Compared by ratio | 190 | 211 | 226 | 234 | 220 | 242 | 250 |

Resin impregnation rate(R/F)% : Weight ratio of resin to fiber

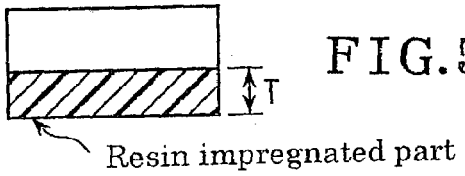
FIG.5(b)
FIG. 6
PRIOR ART
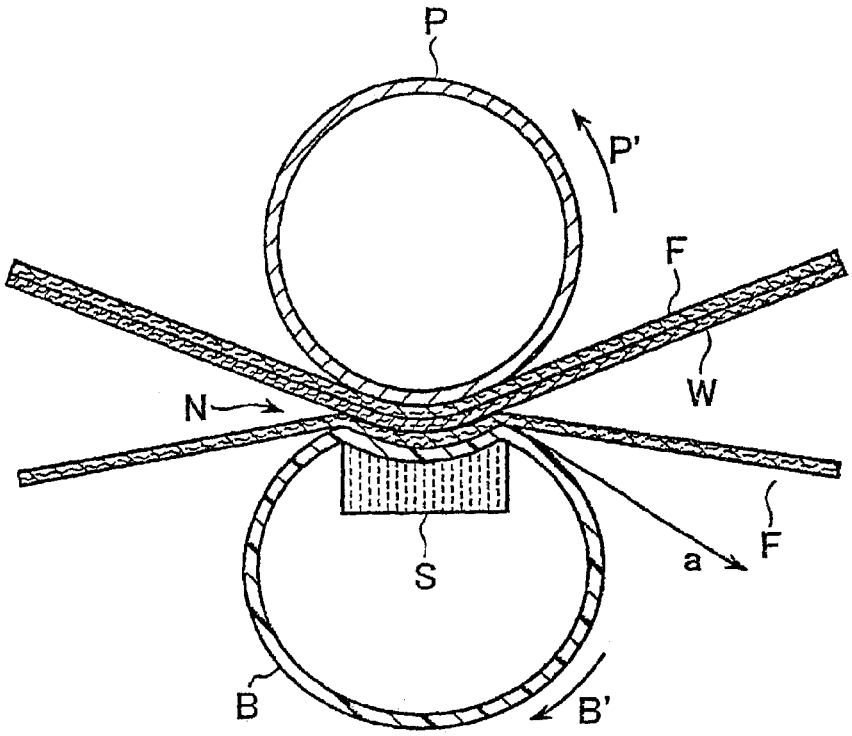
FIG. 7
PRIOR ART
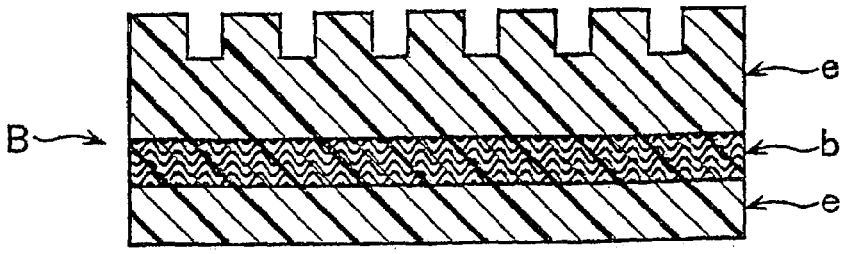

DOCTOR BLADE FOR REMOVING WATER

CROSS-REFERENCE TO RELATED APPLICATIONS

This application claims priority from Japanese patent application 63928/2002, filed Mar. 8, 2002.

FIELD OF THE INVENTION

This invention relates to doctor blades, and particularly to a doctor blade suitable for removing water from an elastic belt in the press part of a papermaking machine.

BACKGROUND OF THE INVENTION

In the shoe press apparatus shown in FIG. 6, which is provided in the press part of a papermaking machine, a pair of felts F, and an air-impermeable, endless, elastic belt B, are pinched in a nip N formed by a press roll P and a shoe S. When the press roll P rotates in the direction of arrow P', the elastic belt B also rotates in the direction of arrow B', and, as a wet paper web W passes through the press part it is pinched by felts F, and water is squeezed from it. Oil is supplied to the inside of the elastic belt B to reduce friction between the belt and the shoe S.

The surface of the shoe S which is opposed to the press roll P conforms to the shape of the outer surface of the press roll. Therefore, the area of the nip can be much larger than the corresponding area in a press apparatus comprising a pair of press rolls (not shown), and a greater water squeezing effect can be achieved. Therefore, the shoe press apparatus has an important advantage in that much less heat is needed for drying the wet paper web W after water is squeezed from it, and accordingly a significant saving in fuel or energy cost can be realized.

As shown in FIG. 7, which is an enlarged cross-sectional view showing the structure of the elastic belt B, the belt comprises a base member b, and high molecular weight elastic members e on both sides of the base member. The base member b, which is preferably a woven fabric having a warp and weft, is provided to impart strength to the elastic belt B as a whole.

The high molecular weight elastic members e are preferably composed of resin such as a urethane resin, having a Shore hardness A of 70 to 98 degrees. The felt contacting surface and the shoe contacting surface of the elastic belt are both composed of such resins.

A plurality of grooves may be formed on the felt-contacting surface of the elastic belt B, so that the water squeezed from the wet paper web W may be held in the grooves.

Compressed air may be supplied to the inside of an elastic belt B to expand the belt to the shape as shown in FIG. 6.

In the nip N, part of the water squeezed from the wet paper web W moves to the elastic belt B through the felt F which moves between the web W and the belt B. Although most of the water which moves through the felt F to the belt B is shaken off in the direction of arrow a in FIG. 6 as a result of the movement of the belt, part of the water will continue to adhere to the elastic belt B and reenter the nip. Thus, when water adheres to the elastic belt B, the water squeezing effect of the press part may not be adequate.

Therefore, it is conceivable that a doctor blade, similar to the doctor blade used to remove water from a press roll, might be brought into contact with the elastic belt B to remove water from the belt.

Doctor blades used in with press rolls include metallic doctor blades, and doctor blades composed of a felt impregnated with a wear-resistant rubber, synthetic resin or the like, as disclosed in Unexamined Japanese Patent Publication No. 20697/1981. Although such doctor blades are effective to remove excess water from a press roll, problems are encountered in attempts to use such doctor blades to remove water from elastic belts.

A metallic doctor blade can efficiently remove water from an elastic belt, but causes the elastic belt to wear out rapidly. There is also a risk of damage caused by digging of the tip of the metallic doctor blade into the belt. Moreover, the expansion of the elastic belt by compressed air results in a bulging of the belt, such that its outer surface departs from a cylindrical shape. Accordingly, the outer surface of the belt is not necessarily straight in the cross machine direction, and it is difficult to make a metallic doctor blade contact the surface of the belt uniformly.

On the other hand, a doctor blade composed of a felt impregnated with a wear-resistant synthetic resin exhibits excellent adhesion to the surface of an elastic belt, and may have an effect of removing water on the surface of an elastic belt. However, when a resin-impregnated felt doctor blade is used with an elastic belt having grooves, water in the grooves may not be adequately removed because the fibers of the doctor blade may adequately get into the grooves of the belt.

SUMMARY OF THE INVENTION

In accordance with the invention, a doctor blade, comprising a fibrous lamination impregnated with resin, is in contact with a mating member movable relative to the doctor blade for removing water from the mating member. The fibrous lamination comprises a fibrous contacting layer in contact with the mating member, and at least one layer in addition to the fibrous contacting layer, said at least one layer being out of contact with the mating member. Fibers in the fibrous contacting layer are oriented substantially in the direction of movement of the mating member relative to said contacting layer, preferably within 15 degrees relative to the direction of movement of the mating member.

In a preferred embodiment, the diameters of the fibers of the fibrous contacting layer are larger than the diameters of the fibers of the at least one layer that is out of contact with the mating member. The resin impregnation rate in the fibrous contacting layer is also preferably less than the resin impregnation rate of the at least one layer that is out of contact with the mating member.

The doctor blade for removing water according to the invention has a greater adhesion to a mating member, due to the fiber orientation in the mating member-contacting layer. In addition, since frictional force is exerted in a direction parallel to the axial direction of the fibers, friction with the mating member is reduced, abrasion of the fibers of the doctor blade decreases and the durability of the doctor blade is improved.

When the mating member is an elastic belt having grooves, the orientation of the fibers at the contacting surface of the doctor blade allows more fibers to enter the grooves of the belt, and consequently, water in the grooves is removed more efficiently.

The fibers of the mating member-contacting layer are oriented substantially in one direction when laid out during the formation of the layer. This one direction will be the same direction in which the mating member moves relative to the doctor blade. When the mating member makes a rotating movement rather than a planar movement, the direction of movement will be considered in the tangential direction. The term "oriented substantially in the direction of movement of the mating member," as used herein with reference to the fibers of a mating member-contacting layer of a doctor blade, therefore means that the fibers are disposed substantially parallel to the direction of movement of the mating member when projected upon a plane extending along such a direction of movement of the mating member. Even if the fibers have windings to some extent due possibly to crimp, they may be considered to be oriented substantially in the direction of movement of the mating member when viewed as a whole. Also, even if they have windings in the thickness direction due possibly to needling, etc., they may be regarded to be oriented substantially in the direction of movement of the mating member when viewed perpendicularly with respect to a plane extending along the direction of movement of the mating member.

BRIEF DESCRIPTION OF DRAWINGS

FIG. 1(*b*) is a cross-sectional view illustrating one shape of a doctor blade in accordance with the invention;

FIG. 1(*c*) is a cross-sectional view illustrating another shape of a doctor blade in accordance with the invention;

FIG. 2(*b*) is an explanatory plan view showing that there are two directions of orientation of fibers in a fibrous lamination;

FIG. 3(*b*) is an schematic view, similar to FIG. 3(*a*), but showing the doctor blade in a deformed condition, with a part of one of its faces in pressing contact with an elastic belt;

FIG. 5(*a*) is a table showing the results of water removal capability and endurance tests of doctor blades in accordance with the invention and comparing those results with results of corresponding tests carried out on comparative examples;

FIG. 5(*b*) is a schematic cross-sectional view illustrating partial resin impregnation in a laminate in accordance with the invention.

FIG. 6 is a schematic, cross-sectional view of a shoe press apparatus used in the press part of a papermaking machine;

FIG. 7 is an enlarged cross-sectional view of a grooved elastic belt used in a shoe press apparatus; FIG. 8(*b*) is an enlarged cross-sectional view showing the relationship between the grooves of an elastic belt and fibers of a doctor blade in accordance with the invention, wherein the fibers are oriented in the direction of the elongation of the grooves.

DETAILED DESCRIPTION OF THE PREFERRED EMBODIMENTS

Figure 1A:
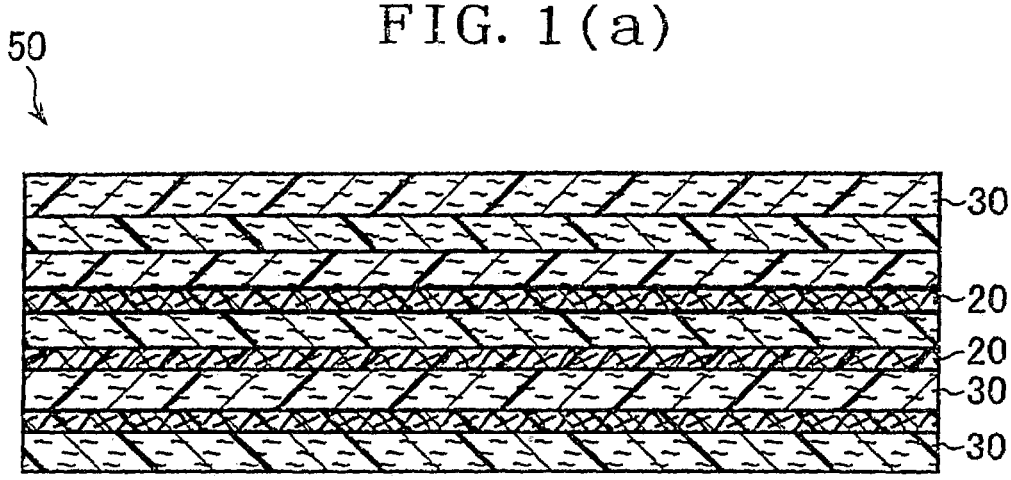
FIG. 1(*a*) is a cross-sectional view of a laminated doctor blade for according to the invention.
Figure 1B:
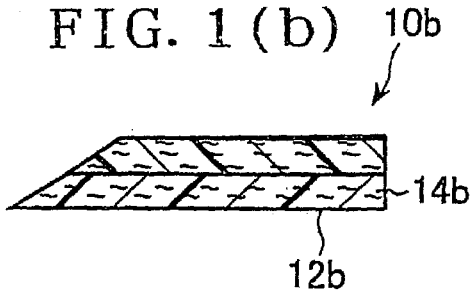
Figure 1C:
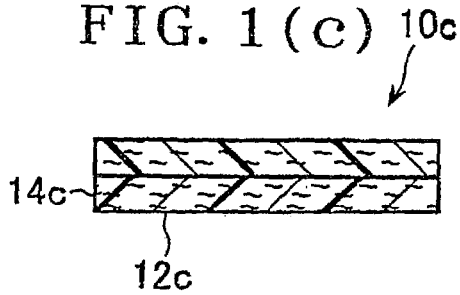

As shown in FIG. 1, the doctor blade according to the invention is made by impregnating a fibrous lamination 50 with resin.

The lamination 50 comprises base material layers 20 and batt fiber layers 30.

Although the base material layers 20 will usually be, woven fabric layers formed from yarns of general-purpose fibers, film, spun bond or molded resin materials may be used as the base material layers. The batt fiber layers 30 are made by layering general-purpose fibers. The lamination 50 is made by laminating and integrating a plurality of base material layers 20 and a plurality of fibrous layers 30 together. In some circumstances, the base material layers 20 can be omitted, so that the lamination 50 is composed only of fibrous layers 30.

In the fibrous layer 30 which comes into contact with a mating member, the fibers are oriented, for example by carding, in the direction of travel of the mating member. Thus, adhesion of the doctor blade to the mating member is improved, and a large number of fibers enter the grooves of the mating member so that water in the grooves is removed.

Generally, abrasion due to fibers in the doctor blade is at the minimum when fibers are rubbed in the axial direction. Therefore, if the orientation of fibers is in parallel with the direction of travel of the mating member, the wear and tear of the doctor blade due to abrasion can be prevented, and the service life of the doctor blade can be extended.

Figure 2A:
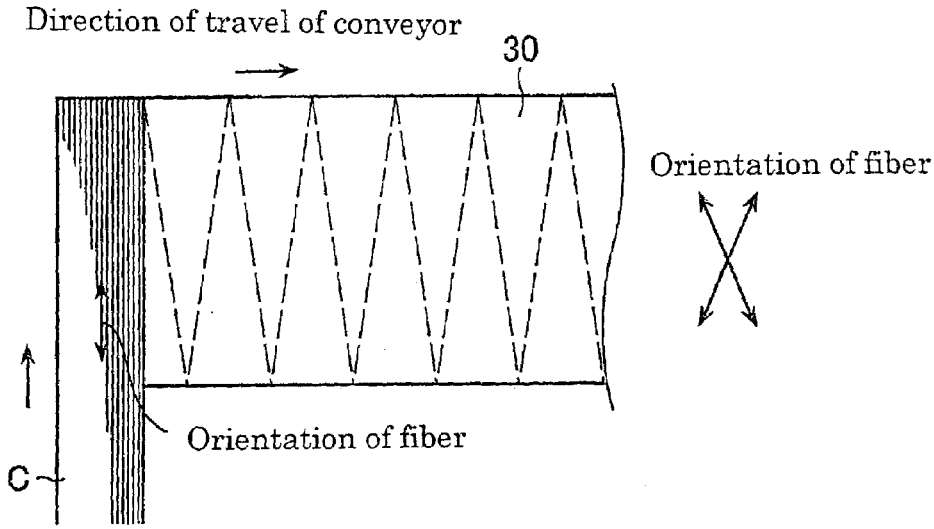
FIG. 2(*a*) is a top plan view illustrating the formation of a fibrous lamination in accordance with the invention, using a cross lapper wherein, after a web is opened by carding, it is laminated on a conveyer.
Figure 2B:
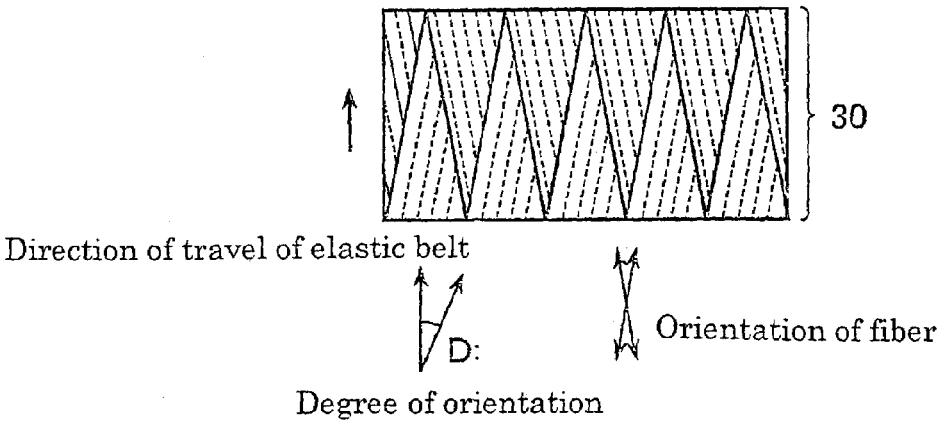

One method for adjusting the orientation of fibers in a fibrous layer, is to form a fibrous layer by laminating a web which is oriented in one direction by carding. Another method, as shown in FIG. 2, is to utilize webs C, which are oriented in one direction by carding, and to laminate the webs alternately at an angle by a cross lapper. It is preferable that the orientation angle D of the fibers be within 15 degrees relative to the direction of travel of the mating member.

In addition, in a fibrous laminate 30, in which the layers are integrated by needling, at least the layer which comes into contact with a mating member is a fibrous layer wherein the fibers are oriented in the direction of travel of the mating member. The fibers in the other layers need not be oriented in the direction of travel of the mating member, and can have any desired orientation, even random orientation.

In the formation of the laminate as shown in FIG. 1, the base material layers and fibrous layers can be first laminated and then intertwined by needle punching. Alternatively, groups of layers may be intertwined preliminarily by needle punching, and thereafter the groups of layers may be intertwined by another needle punching operation to form the laminate.

The base material layers 20 and the fibrous layers 30 may be glued together by resin, etc. However intertwining integration by needle punching has the advantage of suppressing peeling of the layers.

Although general-purpose fibers such as polyamide fibers, polyester fibers, etc. may be used in the base material layers 20 and the fibrous layers 30, it is desirable to use aromatic polyamide fibers and the like when heat resistance is required.

In order to make fibers stick together and prevent the loss of fibers from the doctor blade being produced, a binder comprising a high molecular weight compound may be added by sprinkling when heat meltable fibers are mixed with a fibrous layer 30, or when a fibrous layer is integrated with a base material layer by needling etc. Alternatively a binder comprising a high molecular weight compound may be added by sprinkling after the layers are integrated, and the layers may be subjected to heating before being impregnated with a resin solution.

The resin solution is preferably one in which a hardener, additive, and a thickener such as a methylcellulose, are mixed or scattered in thermoplastic or thermosetting resin or a mixture thereof. The resin may be, for example, SBR (styrene butadiene copolymer synthetic rubber), polyurethane resin, acrylic resin, epoxy resin, or phenol resin. The impregnation level of resin in the laminate 50 may be controlled by increasing or decreasing the amount of thickener is mixed into the resin solution. In selecting the resin, abrasion resistance and resistance to hydrolysis are considered. A single kind of resin, or a mixture composed of several kinds of resin, may be used.

After the laminate 50 is impregnated with resin solution, it is heated to harden the resin, and cut so that the fibers of the layer which comes into contact with a mating member are oriented in the direction of travel of the mating member. If necessary, a taper is formed by machining, and a doctor blade 10*b* or 10*c*, having the shape shown in FIG. 1(*b*) or FIG. 1(*c*), may be obtained.

In the doctor blades 10*b* and 10*c*, the orientations of fibers of the fibrous layers vary. In each doctor blade, the fibers of the layer which comes into contact with a mating member (surfaces 12*b* and 12*c* in FIGS. 1(*b*) and 1(*c*)) are oriented in the direction of travel of the mating member, whereas the fibers at the other surface may have a different orientation.

Although each of the doctor blades 10*b* and 10*c* comprises two layers of fiber having different orientations, it is also possible to form a doctor blade in which the fibers of all the layers are oriented in the direction of travel of the mating member. However when fibers are oriented in the direction of travel of a mating member only in the layer the surface of which comes into contact with a mating member, and a different fiber orientation is used in the other fibrous layers, fibers may be more effectively prevented from falling off due to improved intertwinement when the fibers are integrated by needling.

In these doctor blades 10*b* and 10*c*, the layers wherein fibers are oriented in the direction of travel of a mating member under the surface 12*b* or 12*c* are referred to as mating member contacting layers 14*b* and 14*c*.

In the case of a doctor blade having a taper formed by machining, the upper and lower sides of the doctor blade shown in FIG. 1(*b*) may be reversed. The part having a protrusion formed as a result of tapering is the mating member contacting layer.

As an alternative to the use of resin solution, the resin may be impregnated into the laminate 50 by a method wherein fine particles of resin are impregnated into the surface of the laminate, and heated and pressurized using a press. Similar resins can be used in either case, and abrasion resistance and flexibility should be taken into account in both cases.

The void content of the doctor blade 10 may be controlled by selecting the density of the laminate 50 or the amount of impregnated resin. The void content may also be controlled by adding a foaming agent to the above-mentioned resin solution or fine resin particles.

Frictional drag of the doctor blade against an elastic belt B may be decreased by including an additive which has lubricity, such as molybdenum disulfide, in the resin solution or fine resin particles.

When the fibers forming the layer which comes into contact with the elastic belt B are thick compared to the fibers forming the layers which are not in contact with the belt, the belt has a superior ability to remove water from the belt due to the high rigidity of the fibers in the belt-contacting layer. However, when all the fibers in the belt-contacting layer are thick, the surface properties of a doctor blade are inferior, and adhesion of the blade to the elastic belt is decreased. Superior effects may be obtained by mixing thin fibers into the thick fibers.

Figure 3A:
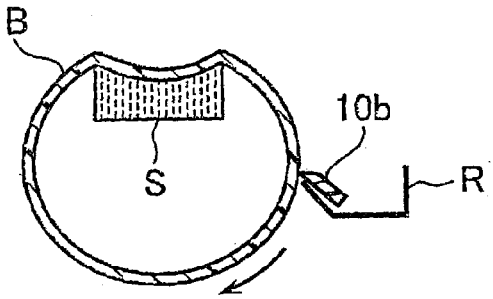
FIG. 3(*a*) is a schematic view showing a doctor blade of FIG. 1(*b*) used in a shoe press apparatus, where only the tip of the doctor blade is in a pressing contact with an elastic belt.
Figure 3B:
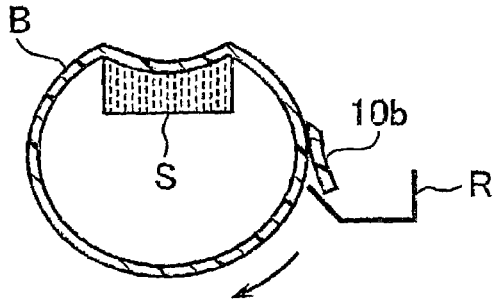

FIGS. 3(*a*) and 3(*b*) show the doctor blade 10*b* of FIG. 1(*b*) used in a shoe press apparatus. (The press roller is not shown). The doctor blade 10*b* may be used either with only its tip pressing against the mating belt B as shown in FIG. 3(*a*), or with part of its surface 12*b* pressing against the belt as shown in FIG. 3(*b*). In either case, a mating member contacting layer 14*b* of the doctor blade 10*b* is in contact with the elastic belt B. When the doctor blade 10*b* is used as shown in FIG. 3(*b*), the area of the blade which is in contact with the belt B is broader. The water which is removed by the doctor blade 10*b* is made to flow to a water receiver R.

Examples of a doctor blade in accordance with the invention will now be described. It should be understood, however, that the invention is not limited to these specific examples.

In Examples 1 and 2, a woven fabric of plain weave having spun polyester (PET) yarn as its warp and weft, and a basis weight of 100 g/m$^2$, was used as a base material, and polyester fiber (17 dtex) was used for the fibrous batt layers. Fibers oriented in one direction by carding were used for all the layers.

Polyester fibrous batt layers were provided on both sides of the base material, and integrated with the base material by needling. The amount of the polyester fiber in each fibrous batt layer was 120 g/m$^2$.

Three of the foregoing structures were piled up and integrated by needling. Moreover, a 120 g/m$^2$ layer of polyester fiber was laminated while integrated by needling, and positioned so that its fibers were oriented in the direction of travel of a mating member. A lamination having an areal weight (Metsuke) 3500 g/m$^2$ and a thickness 10 mm as a whole was obtained for Example 1 and a thickness of 5 mm was obtained for example 2. The density of each lamination was 0.35 g/cm$^3$.

In Example 3, a woven fabric of plain weave having spun polyester (PET) yarn as warp and weft (basis weight 100 g/m$^2$) was used for a base material and 17 dtex polyester fiber was used for the fibrous batt layers. Fibrous layer oriented in one direction by carding were used for seven layers on the top side of the blade, which was in contact with a mating member. Fibrous layers of different orientation were used for other layers.

The polyester fibrous layers were integrated with the base material by needling, and fibrous layers were provided on both sides of the each layer of base material. The amount of the polyester fiber in each layer was 120 g/m$^2$.

Three of the above structures were piled up and integrated by needling. The 120 g/m$^2$ polyester fiber layers were integrated by needling so that the fibers of the seven fibrous layers on the side which was in contact with the mating member were oriented in the direction of travel of the mating member. As a result, a laminate having an areal weight (Metsuke) of 3500 g/m$^2$ and a thickness of 10 mm as a whole was obtained. The density of this lamination was 0.35 g/cm$^3$.

In Example 4, a woven fabric of plain weave having spun polyester (PET) yarn as warp and weft (basis weight 100 g/m$^2$) was used for a base material, and 40 dtex polyester fiber was used for seven batt fiber layers on the top side which was in contact with a mating member. Fibrous layers of different orientation comprising 17 dtex polyester fibers were used for other layers.

The polyester fibrous layers were integrated with the base material by needling, and the fibrous layers were provided on both sides of each layer of base material. The amount of polyester fiber in each layer was 120 g/m$^2$.

Three of these structures were piled up and integrated by needling. Moreover, polyester fiber 120 g/m$^2$ was integrated by needling so that the fibers of the seven fibrous layers on the side which was in contact with the mating member were oriented in the direction of travel of the mating member. As a result, a laminate having an areal weight (Metsuke) of 3500 g/m$^2$ and a thickness of 10 mm as a whole was obtained. The density of this lamination was 0.35 g/cm$^3$.

In Example 5, woven fabric of plain weave having spun polyester yarn (PET) as warp and weft (basis weight 100 g/m$^2$) was used for a base material. Fibrous batt layers were composed of 40 dtex polyester fiber and 17 dtex polyester fiber, mixed at a weight ratio of 1:1. These fibers were oriented in one direction by carding and used for seven layers on the top side of the blade, which was in contact with a mating member. Fibrous layers of different orientation, comprising 17 dtex polyester fibers were used as other layers.

The polyester fibrous layers were integrated with the base material by needling, and fibrous layers were provided on both sides of each layer of base material. The amount of the polyester fiber in each layer was 120 g/m$^2$.

Three of the above structures were piled up and integrated by needling. 120 g/m$^2$ of polyester fiber was integrated by needling so that the fibers of the seven fibrous layers on the side in contact with the mating member were oriented in the direction of travel of the mating member. As a result, a laminate having an areal weight (Metsuke) of 3500 g/m$^2$ and a thickness of 10 mm as a whole was obtained. The density of this lamination was 0.35 g/cm$^3$.

In Comparative examples 1 and 2, the base material was a woven fabric of plain weave composed of spun polyester (PET) yarn as warp and weft, having a basis weight 100 g/m$^2$. Fibrous layers of 17 dtex polyester fiber oriented in random directions by carding were used for all the layers.

The polyester fibrous layers were integrated with the base material by needling, and fibrous layers were provided on both sides of each layer of base material. The amount of the polyester fiber in each layer was 120 g/m$^2$.

Three of these structures were piled up and integrated by needling. 120 g/m$^2$ of polyester fiber was integrated by needling, and a laminate having an areal weight (Metsuke) of 3500 g/m$^2$ and a thickness of 10 mm as a whole was obtained. The density of this lamination was 0.35 g/cm$^3$.

Next, a resin solution was prepared by adding a thickener to a solution comprising styrene butadiene latex (SBR) and a hardener. These components were mixed and diluted with water. This resin solution was applied to the one side of the above-described laminate.

A doctor blade of Comparative example 2 and doctor blade of Example 2 according to the invention were different from others in that the depth T, as shown in FIG. 5(*b*), to which the resin solution was impregnated into the laminate was 5 mm in the direction of thickness.

The resin was dried and hardened, and cutting was conducted so that the fibers of the layer which contacts a mating member were oriented in the direction of travel of the mating member. Then, a taper, as shown in FIG. 1(*b*), was formed by machining, and a doctor blade having a resin impregnation rate (the weight ratio of solid resin to the laminate) of 20% was obtained.

The laminates of Comparative example 1, and Examples 1 and 3–5 were impregnated uniformly with resin throughout their thicknesses.

Figure 4:
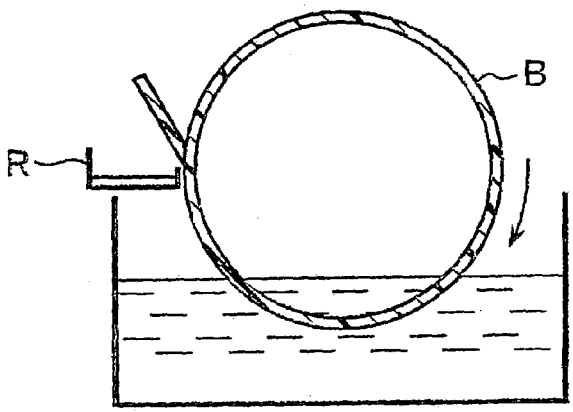
FIG. 4 is a schematic view of an apparatus for conducting water removal and endurance testing of doctor blades.

A water removal capability test, and an endurance test was conducted for each of these doctor blades, using the apparatus shown in FIG. 4. In this apparatus, an endless belt B was rotated in the direction of the arrow, with part of the belt immersed and soaked in water. The doctor blades were positioned in contact with belt B, and the amount of removed water, and the durability of doctor blades in terms of abrasion loss, were measured.

A belt made of polyurethane, and having a plurality of surface grooves, 1 mm in width, 1 mm in depth, and spaced at intervals of 3 mm between grooves, was used as the test belt.

In the water removal capability test, the belt B in the test apparatus was rotated at 60 rpm for five minutes. The amount of water removed by the doctor blade, that is, the amount of water collected in a water receiver R during that five minute interval, was measured.

In the endurance test, the durability of the doctor blade was measured by rotating the belt B at 100 rpm for 1000 hours in the same apparatus.

The results of the water removal capability test and the endurance test are shown by ratio in FIG. 5. A large value in the water removal capability test results corresponds to a high water removal capability. A large value in the endurance test results corresponds a high durability, that is, a low abrasion loss, in the doctor blade.

As seen from FIG. 5, the doctor blades of Examples 1–5 according to the invention exhibit superior water removal capability and durability compared to the water removal capability and durability of Comparative examples 1 and 2.

Figure 8A:
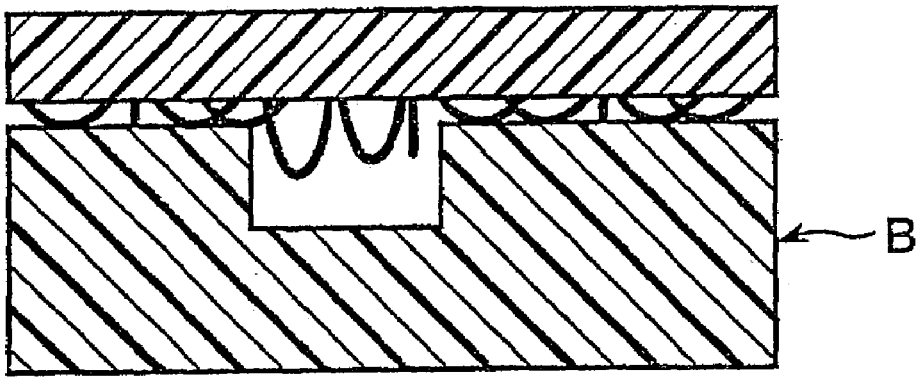
FIG. 8(*a*) is an enlarged cross-sectional view showing the relationship between randomly oriented fibers of a doctor blade in accordance with a comparative example and the grooves of an elastic belt.
Figure 8B:
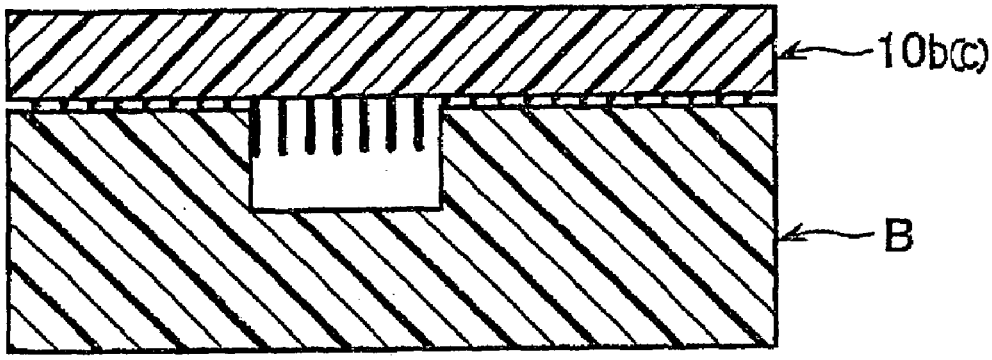

FIGS. 8(*a*) and 8(*b*) depict the manner in which the fibers of a doctor blade enter the grooves of a mating member. In FIG. 8(*a*) the doctor blade is in accordance with Comparative examples 1 and 2, in which the fibers which are in contact with the mating member are oriented in random directions. On the other hand, FIG. 8(*b*) shows a doctor blade according to the invention, in which the fibers which are in contact with a mating member are oriented along the grooves. As seen in these figures, the amount of fiber which enters the grooves is larger in the case of FIG. 8(*b*) than in the case of FIG. 8(*a*), and relatively larger amount of water in the grooves are removed in the case of FIG. 8(*b*). It is to be noted that FIG. 8(*b*) in effect represents a situation in which the semi-circular shapes in FIG. 8(*a*) are revolved about 90 degrees.

Although the invention has been described in detail with reference to an elastic belt in a shoe press apparatus, the mating member from which water is to be removed is not necessarily limited to the elastic belt of a shoe press apparatus.

A doctor blade according to the invention exhibits a greater adhesion to the mating member as a result of the orientation of its surface fibers. In addition, since frictional force is applied in a direction parallel to the axial direction of the fiber friction with the mating member is reduced, and abrasion of the fibers of the doctor blade decreases, with the result that the durability of the doctor blade is improved. When the mating member is an elastic belt having grooves, the invention allows a greater number of fibers of the doctor blade to enter the grooves for more efficient removal of water.

What is claimed is:

1. In an apparatus comprising a doctor blade comprising a fibrous lamination impregnated with resin, and a mating member movable relative to the doctor blade, said doctor blade being in contact with said mating member for removing water from said mating member, and said fibrous lamination comprising a fibrous contacting layer in contact with said mating member, and at least one layer in addition to said fibrous contacting layer, said at least one layer being out of contact with the mating member, wherein fibers in said fibrous contacting layer are oriented substantially in the direction of movement of said mating member relative to said contacting layer, the improvement wherein the resin impregnation rate of said fibrous contacting layer is less than the resin impregnation rate of said at least one layer.

2. In an apparatus comprising a doctor blade comprising a fibrous lamination impregnated with resin, and a mating member movable relative to the doctor blade, said doctor blade being in contact with said mating member for removing water from said mating member, and said fibrous lamination comprising a fibrous contacting layer in contact with said mating member, and at least one layer in addition to said fibrous contacting layer, said at least one layer being out of contact with the mating member, wherein fibers in said fibrous contacting layer are oriented substantially in the direction of movement of said mating member relative to said contacting layer, wherein said fibers in said fibrous contacting layer are oriented within 15 degrees relative to the direction of movement of said mating member, the improvement wherein the resin impregnation rate of said fibrous contacting layer is less than the resin impregnation rate of said at least one layer.

3. In an apparatus comprising a doctor blade comprising a fibrous lamination impregnated with resin, and a mating member movable relative to the doctor blade, said doctor blade being in contact with said mating member for removing water from said mating member, and said fibrous lamination comprising a fibrous contacting layer in contact with said mating member, and at least one layer in addition to said fibrous contacting layer, said at least one layer being out of contact with the mating member, wherein fibers in said fibrous contacting layer are oriented substantially in the direction of movement of said mating member relative to said contacting layer, the improvement wherein the diameters of the fibers of said fibrous contacting layer are larger than the diameters of the fibers of said at least one layer.

4. The apparatus as claimed in claim 3, wherein the resin impregnation rate of said fibrous contacting layer is less than the resin impregnation rate of said at least one layer.

* * * * *